US006702028B1

(12) United States Patent
Heggholmen

(10) Patent No.: US 6,702,028 B1
(45) Date of Patent: Mar. 9, 2004

(54) APPARATUS AND METHOD FOR PRODUCING OIL AND GAS

(76) Inventor: Jon Kàre Heggholmen, Alvheim, 5336 Tjeldstø(NO)

( * ) Notice: Subject to any disclaimer, the term of this patent is extended or adjusted under 35 U.S.C. 154(b) by 0 days.

(21) Appl. No.: 10/030,213

(22) PCT Filed: Jun. 15, 2000

(86) PCT No.: PCT/NO00/00207

§ 371 (c)(1),
(2), (4) Date: Dec. 11, 2001

(87) PCT Pub. No.: WO00/77343

PCT Pub. Date: Dec. 21, 2000

(30) Foreign Application Priority Data

Jun. 16, 1999 (NO) ..... 19992947

(51) Int. Cl.[7] ..... E21B 43/16; E21B 47/04

(52) U.S. Cl. ..... 166/372; 166/68; 166/105.5; 166/250.03; 166/250.15

(58) Field of Search ..... 166/369, 372, 166/373, 68, 105, 105.5, 250.15, 250.03

(56) References Cited

U.S. PATENT DOCUMENTS

| | | | | |
|---|---|---|---|---|
| 2,293,196 A | | 8/1942 | Crump | |
| 3,410,217 A | * | 11/1968 | Kelley et al. | 417/58 |
| 3,718,407 A | * | 2/1973 | Newbrough | 417/108 |
| 3,894,583 A | * | 7/1975 | Morgan | 166/68 |
| 4,251,191 A | * | 2/1981 | Gass et al. | 417/54 |
| 4,405,291 A | * | 9/1983 | Canalizo | 417/393 |
| 4,460,048 A | * | 7/1984 | Smith et al. | 166/375 |
| 4,502,536 A | | 3/1985 | Setterberg | |
| 4,708,595 A | * | 11/1987 | Maloney et al. | 417/109 |
| 4,762,176 A | | 8/1988 | Miller | |
| 5,257,665 A | * | 11/1993 | Watkins | 166/372 |
| 5,271,465 A | * | 12/1993 | Schmidt et al. | 166/297 |
| 5,343,945 A | * | 9/1994 | Weingarten et al. | 166/105.5 |
| 5,482,117 A | | 1/1996 | Kolpak | |
| 5,497,832 A | * | 3/1996 | Stuebinger et al. | 166/369 |
| 5,634,522 A | * | 6/1997 | Hershberger | 166/372 |
| 5,735,346 A | * | 4/1998 | Brewer | 166/250.03 |
| 5,857,519 A | * | 1/1999 | Bowlin et al. | 166/105.6 |
| 6,039,121 A | * | 3/2000 | Kisman | 166/369 |
| 6,089,322 A | * | 7/2000 | Kelley et al. | 166/370 |
| 6,119,781 A | * | 9/2000 | Lemetayer et al. | 166/369 |
| 6,237,691 B1 | * | 5/2001 | Kelley et al. | 166/370 |

FOREIGN PATENT DOCUMENTS

| | | |
|---|---|---|
| GB | 2250544 A | 6/1992 |
| GB | 2326895 A | 1/1999 |

* cited by examiner

*Primary Examiner*—David Bagnell
*Assistant Examiner*—Jennifer H Gay
(74) *Attorney, Agent, or Firm*—Onsagers AS; Christian D. Abel

(57) ABSTRACT

The main problem area this invention is solving, is concerning reservoirs containing gas with to low well-head pressure. It is therefore desirable to increase the well-head pressure by applying downhole pumps, however this is not possible if gas is present. The core idea in this present invention, is to place a pump (5) in a "bath" of oil (14), in which oil "bath" (14) makes a gas seal (11), assuring the pump only to be imposed to oil without gas. Oil and gas from the reservoir (1) flows trough perforations (2), into a ring-space (3). This creates a significantly pressure drop of the mixture, in which creates turbulence so the gas content will separate from the oil. The pressure drop is regulated by the gas pressure valve (4). Gravitation forces the oil downwards, thus generating the important

9 Claims, 4 Drawing Sheets

7
4
8
10
6
13
3
11
12
9
1
2
5
15
14

APPARATUS AND METHOD FOR PRODUCING OIL AND GAS

FIELD OF INVENTION

This present invention enhances the production capacity from oil and gas reservoirs by combining a downhole gravitational separation process and submersible downhole pumps. In on of the preferred embodiments the downhole gravitational separating process win be preformed to a such degre of pureness that the oil will remain gas-free throughout the whole transportation of the oil, which especially is important when oil pressure is significantly dropping when transported upwards through production tubings.

BACKGROUND OF THE INVENTION

Most reservoirs contains a mixture of oil and gas, but the ration may vary. It is also usual that oil contains water and other liquids to some extent, so the further use of the term oil is therefor meant to also include water and other liquids.

Production methods of such reservoirs are restricted by the well-head-pressure, that is the reservoir pressure minus the pressure drop towards the surface (pressure drop due to the oil column height). The reservoir pressure is decreasing as production take place. The production of oil, that is the volume-flow of oil, is determined by a sufficiently well-head-pressure to be economical feasible, and as a minimum this requires at least a positive well-head-pressure.

To sustain or increase the reservoir pressure, a common solution is to reinject produced gas, and inject water and chemicals into the reservoir. However, in many cases, it is not physical or economic feasible to create or sustain a sufficiently reservoir pressure by these methods. This cause for a need and a desire for other solutions, such as using submersible pumps to pump the oil up.

An additional reason why one might want to make use of downhole submersible pumps, is that this allows reservoir pressure at borehole to drop, thus a larger pressure difference throughout the reservoir is created. This means a larger flow towards the borehole and larger production.

If there is a very small ration of gas present (approximately less than 10 vol % gas) in the reservoir, regular submersible downhole motor pumps are applicable, and are therefore usually used. This prolongs the production lifetime of the reservoir, and thus increase the total volume produced from the reservoir. However, if there is a large amount of gas present, these kinds of pumps are not applicable. Such pumps only allows a limited amount of gas to be entrained therein, without developing problems which may damage the pump and generally cause unsatisfactory operations.

Creative research has resulted in different kinds of centrifugal separation systems, which separates gas from the oil-gas mixture, thus making downhole pumps applicable. An example of such separating system is patent publication NO 3000515 B1, which has rotating helical bafflers within the production tube, creating larger centrifugal forces on the oil than it does on the lighter gas. A tubing within the production tube collects this separated oil, and it is then pumped upwards. U.S. Pat. No. 5,482,117 is based on the same centrifugal principle, but makes use of stationary helical bafflers in stead of rotating helical bafflers. In addition, these patents suggest to make use of the separated gas, as so called "gas-lift". Gas due to it has low weight per volume, does not have the same pressure drop in heights as oil, thus when it is injected in the oil column above the pump this will increase the pressure, lifting the oil upwards.

Systems based on centrifugal separation are characterized by requiring complex baffler constructions, and complex tubing arrangements to make space for: bafflers, pumps and the two tubes for the gas and the oil. Further, rotational bafflers are fairly energy (electricity) consuming. At some production sites electricity is not easily or economic available, such as off-shore production sites.

In addition when a very high ratio of gas occur, in the case for rotational bafflers, the baffler motor might overheat due to the reduced heat capacity in oil-gas mixture. In the case for stationary bafflers, a pressure drop will occur proportional with the number of turns the helical baffler has, thus larger pump power will be required. The centrifugal separation does not necessary imply a totally separation, thus an additional separation is needed at ground level. Further problems could be that the helical bafflers may easily be plunged up, even if small object enters into the path.

Due to these problems it is desirable to find new solutions making regular submersible downhole motor pumps applicable for reservoirs containing gas. Until now, centrifugal separation methods seems to be the only solution the industry has come up with to solve this problem.

However, to separate gas to make regular submersible downhole motor pumps applicable in reservoirs containing gas, is only one of the objectives by this present invention. During production of oil, it is transported vertically through production tube, thus the oil pressure will decrease. So, even if gas apparently seems separated from oil down in the tubing, this is not correct since gas will "appear" proportionally with the pressure decrease in height, due to gas is much more compressible than oil. That is, the gas together with oil is so compressed at high pressures (at large depths) that it seems not to be present. When the pressure of this mixture decreases, the gas expand (in volume) relatively much more than oil. This causes many problems. One is that the oil produced is not pure enough to be transported away and therefore needs additional separation. When oil is transported over long distances this requires additional pumping activities, which means no gas can be present. So, another accomplishment of this present invention is performing the downhole separating process to a such degree of pureness that the oil will remain gas-free throughout the whole transportation of the oil production.

SUMMARY OF THE INVENTION

This present invention enhances production capacity from oil and gas reservoirs. This is primary achieved by making regular submersible downhole motor pumps applicable in oil reservoirs containing gas in a more economical and profitable way. This could partly be achieved by making a solution not being depended on centrifugal separation. Further, this invention is understood to be easier and less expensive to make and use, and also be more sustainable. In addition this invention has the opportunity, if desired, to produce totally separated products of oil and gas.

The core idea in this present invention is to place a pump 5 in a <<bath>> of oil 14, in which oil <<bath>> 14 makes a gas seal assuring the pump only to be imposed to oil without gas. In one of the preferred embodiments (FIG. 1), oil and gas from the reservoir flows trough perforations 2, into a ring-space 3. This creates a significantly pressure drop of the mixture, in which creates turbulence so the gas content will separate from the oil. The pressure drop is regulated by the gas pressure valve 4.

Mainly due to gravity and to some extent the pumping activity 5, the mixture flow is directed downwards. During a limited time this mixture will appear in a turbulent flow, then most gas will escape from the oil. The remaining gas content will be grouping together as larger bobbles. Since gas is lighter than oil, the gas contents will increase its buoyancy relative to oil during the grouping process. This increased buoyancy creates a flow of gas in the opposite direction, that is upwards, at a speed relative larger than the oil flow downwards. At some height level 11, the turbulent flow turns to laminar flow, and it is from this height level and downwards the <<bath>> of oil is present. Then, only an insignificant content of gas is present, this is the height level 11, which also is referred to as the gas seal 11.

Viewed isolated, this gravitational separation principle is in its self a technology which from U.S. Pat. No. 2,293,196 was known to the industry already in 1939 (see FIG. 4). And of course, at that point of time, there were also an awareness of the consequences of small well-head-pressure. The same U.S. Pat. No. 2,293,196 suggested therefore to repressure the reservoir by the produced gas, however despite this awareness, no submerged pump was then suggested to be used underneath the gas-seal. This opportunity was probably not seen by this US patent inventor, nor the remaining industry developers so far, due to the obstacles such an implementation of a submergible pump would imply.

First and most important, a regulation system that can assure that gas-seal 11 never to break underneath the intake level 15 for the pump 5, is the main key that enables this present invention to operate. A regulation according to the regulator that U.S. Pat. No. 2,293,196 suggested, can not accomplish this. Locking at FIG. 4, representing the main idea from U.S. Pat. No. 2,293,196, we can get an understanding of the restrictions the regulator 18 in that patent causes. It is also important to emphasize that this U.S. Pat. No. 2,293,196 main objective is to separate, and has no suggestions of adding lifting power what so ever to the oil column. When fluid height level 20 approaches the lower end of the inner tubing, the fluids well-head pressure (PWH) increases relatively to the gas pressure (GP), like a wave motion. The diaphragm 19 inside the regulator 21 is mechanical linked to the fluid production flow valve 21, then reducing the production allowing fluid to accumulate. Fluid level 20 then increases, reducing fluids well-head pressure (PWH) relatively to gas pressure (PG), thus making the valve 21 open for production again.

However, if a pump had been put at the end of the inner tubing at the separation system presented in FIG. 4, the regulator 18 would not work A reduction of the height level 20 would not have any significant impact on the well-head pressure (PWH), since this pressure difference caused in ring-space would have to work its way through the pump, or even maybe several pumps. Since there would be no significantly pressure variations relative to gas pressure (GP), the diaphragm 19 would not move, thus no regulation. To understand that the pumps tends to sustain the well-head pressure (WHP), it is fruitful to observe what would happen if height level 20 increases. Then the pump would continue its pumping operation, therefore causing an approximately sustained well-head pressure (PWH). And even if these pressure variations could work its way through the pump(s), it would at least cause a to large delay on making an effect on the regulator 18, that is the response time would be way to slow.

A conclusion of the above mentioned, is that the present invention requires a much more sophisticated regulation system to sustain the desired height of the gas seal, if a pump is placed into the inner tubing of the regulation system presented in FIG. 4. According to this present invention, now referring to FIG. 1, the most efficient way to regulate this is to survey the height level of the gas seal by a height measurer 9, and process this information via a regulating processor to control the regulation control variables. The regulating processor would preferably be a computer processor (not drawn). Anyhow, the key for success here is to identify the need for a surveillance of the height of the gas seal.

Secondly there are some geometrically restrictions which must be met, in order to geometrically allow gas to separate, mainly this means that the spacing in ring-space 3 need to be large enough to physically enabling gas bobbles to escape. Also, the distance from perforations 2 and gas-seal 11 must be long enough to give the gas enough time to escape.

An other example of known gravitational separation is UK Patent Application GB 2 326 895, which separates water from a oil-gas mixture over the well-tube distance, by orienting the well-tube in a non-vertical direction. Since the oil-gas mixture is lighter then water, it will position itself at the top part of the tube and is then guided into a inner tubing and then pumped further. However, the pump here has no assurance not to be imposed by significantly amounts of gas.

BRIEF DESCRIPTION OF THE DRAWINGS

Drawing 1 is one of the preferred embodiments of the invention.

Drawing 2 is another preferred embodiment of the invention, with reservoir flow inlet control abilities.

Drawing 3 is similar to drawing 2, but with more explanatory details regarding the surroundings.

Drawing 4 is representing the main idea from U.S. Pat. No. 2,293,196, as an representation of prior art.

DESCRIPTION OF THE PREFERRED EMBODIMENTS

Figure 1:
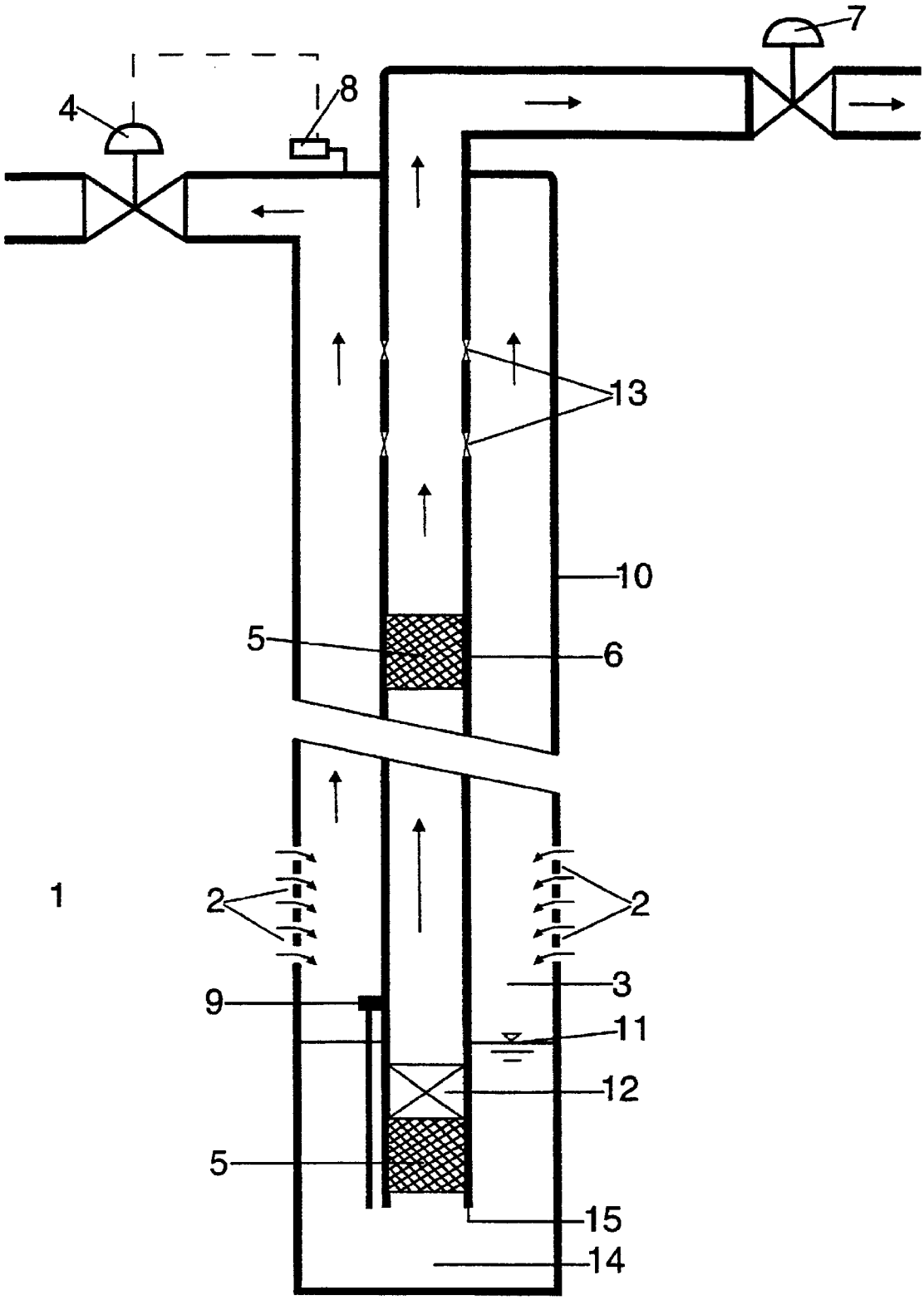

As mention, the main objective by this invention is to make submersible pumps applicable for oil production in oil reservoirs where mixtures of oil and gas are present, especially when reservoir- or well-head-pressure is low. Referring to FIG. 1, this is accomplished by the use of an gravitational separator, allowing oil to aggregate at the bottom of a outer tubing 10. A mixture of oil and gas flows trough perforations 2 into a ring-space 3. The gas pressure in the ring-space 3 is measured with the pressure meter 8 and is regulated by the valve 4.

The pressure in the ring-space 3 is regulated to be much lower than in the reservoir 1. This creates a pressure drop of the mixture, as it enters the ring-space 3, thus turbulence is created. Gravity acts upon this turbulent mixture and tries to force it downwards.

Due to the pressure drop, gas is allowed to expand, and in addition due to the turbulent flow most of the gas will immediately escape from the oil, towards the valve 4. Further, affected by the turbulence, the reminding gas will gather as bubbles; thus increase its buoyancy relative to the oil and move upwards. The oil will flow downward, mostly along the welltubings, aggregating a "oil-bath" 14 at the end. At the height level where this aggregated "oil-bath" begins, is where the turbulent mixture turns into a laminate flow of oil without gas, making a gas-seal 11. It is crucial that this gas-seal 11 is kept above the oil intake 15, thus allowing no gas to enter the pump 5. The gas seal level 11, is continuously or frequently measured by a height measurer 9. The gas seal level 11 height information is used by a regulator which processes this information to control the pump power 5 and the outlet-valve 12. If the gas-seal 11 level is to low, pump power is reduced or outlet-valve 12 opening is reduced, or a combination of these. In the other hand, if the gas-seal 11 level is to high, pump power is increased or outlet-valve 12 opening is increased, or a combination of these. In addition if necessary, this regulator can also be combined with gas pressure information and regulate gas pressure by valve 4. A reduction of gas pressure, could increase the inlet flow from the reservoir due to a larger pressure drop. This way the height of gas seal level 11 can be reestablish if it is to low. The opposite would be to increase gas pressure if height of gas seal level 11 is to high.

The main control variables of this regulation system are pump 5 power, valve 12 and valve 4, and main input values are height level of gas-seal 11. Other variables and values could also be used, for example gas and oil production rates and oil production valve 7.

Apart for the regulation, it is also crucial that there is a sufficient spacing between gas-seal 11 and perforations 2, allowing separation to have time to occur. Also the spacing in ring-space 3 has to be large enough to physically enable gas bobbles to escape.

The pump 5 is placed underneath the gas seal level 11, and a regular submersible pump 5 can now be applied. Preferably this pump is a centrifugal type, or if necessary a multiple stage type centrifugal pump. Alternatively several pumps along the tubing, with spacing between them could be used. The pump or pumps are positioned inside the tubing 6, preferably the first pump 5 is near the intake 15, or at least underneath (in height level) the gas-seal 11. However if sufficiently volume-flow of oil is assured, the first pump 5 could be position further up inside the tubing 6.

In special cases where it is not so important that the produced oil is completely free of gas, or where power supply to the pumps are low, use of gas lifts after the pumping action could be a alternatively additional solution. The oil is produced through valve 7. The oil column inside the tubing 6, are given an additional lift by several gas valves 13 along the tubing 6, reducing the required power from pump 5. The gas will be pressured into the oil-column since the pressure drop in height is significantly larger for the oil than the gas, due to their weight differences.

These gas valves 13 would in most cases be preferred to be one-way-valves, especially if large variations of gas pressures occurs. If it is desired, to produce totally gas free oil, the column pressure will be regulated to always to be larger than ring-space 3 pressure (that is the gas pressure). Gas is then not able to enter the oil column. This can be achieved by reducing ring-space 3 pressure through valve 4, or increase column pressure trough valve 12 or increase pump 5 power, or as a combination of this. Of course, another possibility obtaining gas free oil, is not to apply gas lifts at all but this again would require larger pumps.

When alternatively using several pumps inside and spaced along the tubing 6, such gas lift could not be applied at height levels underneath the upper pump since, the gas then would make the submersible pumps inapplicable.

Figure 2:
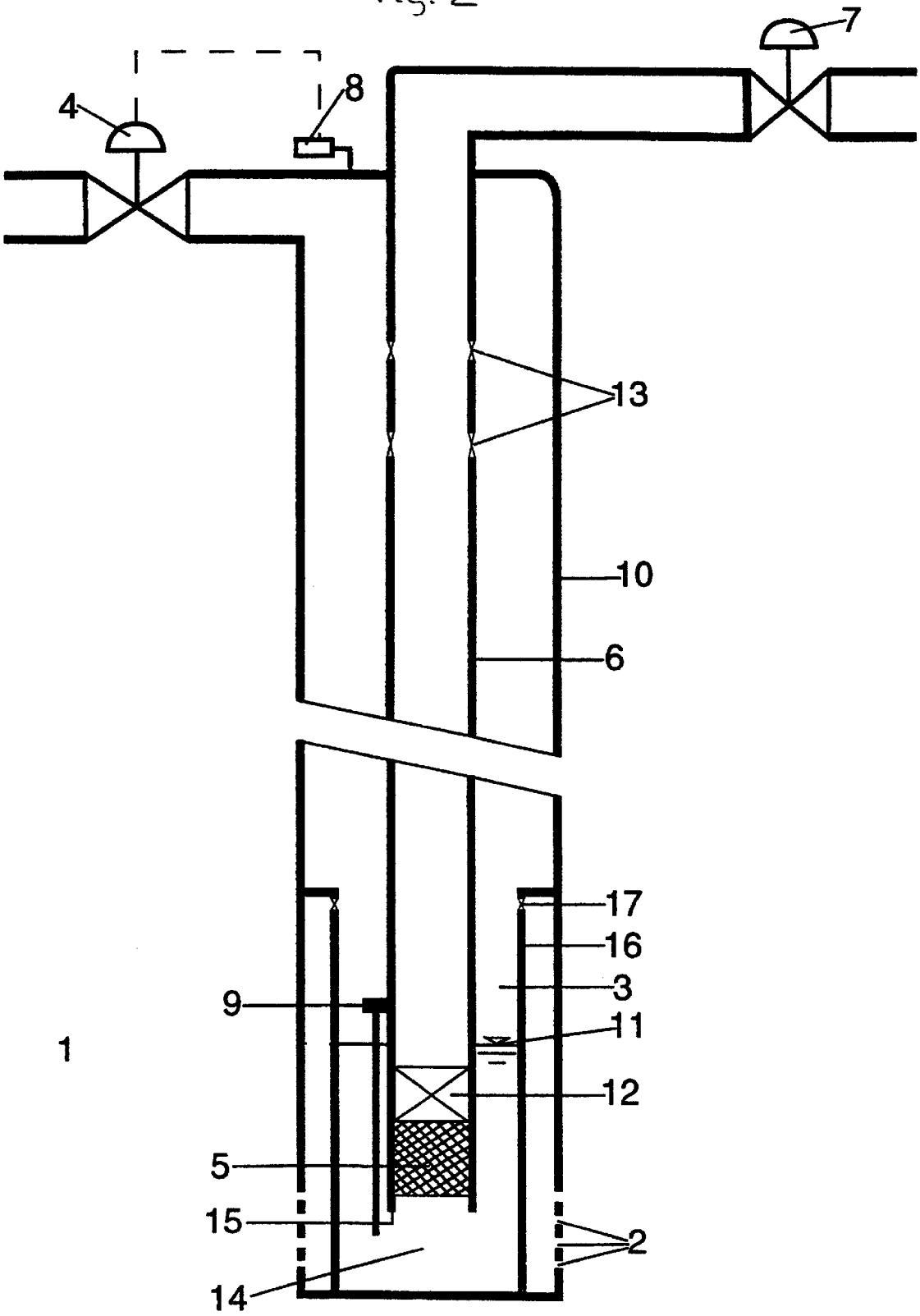
Figure 3:
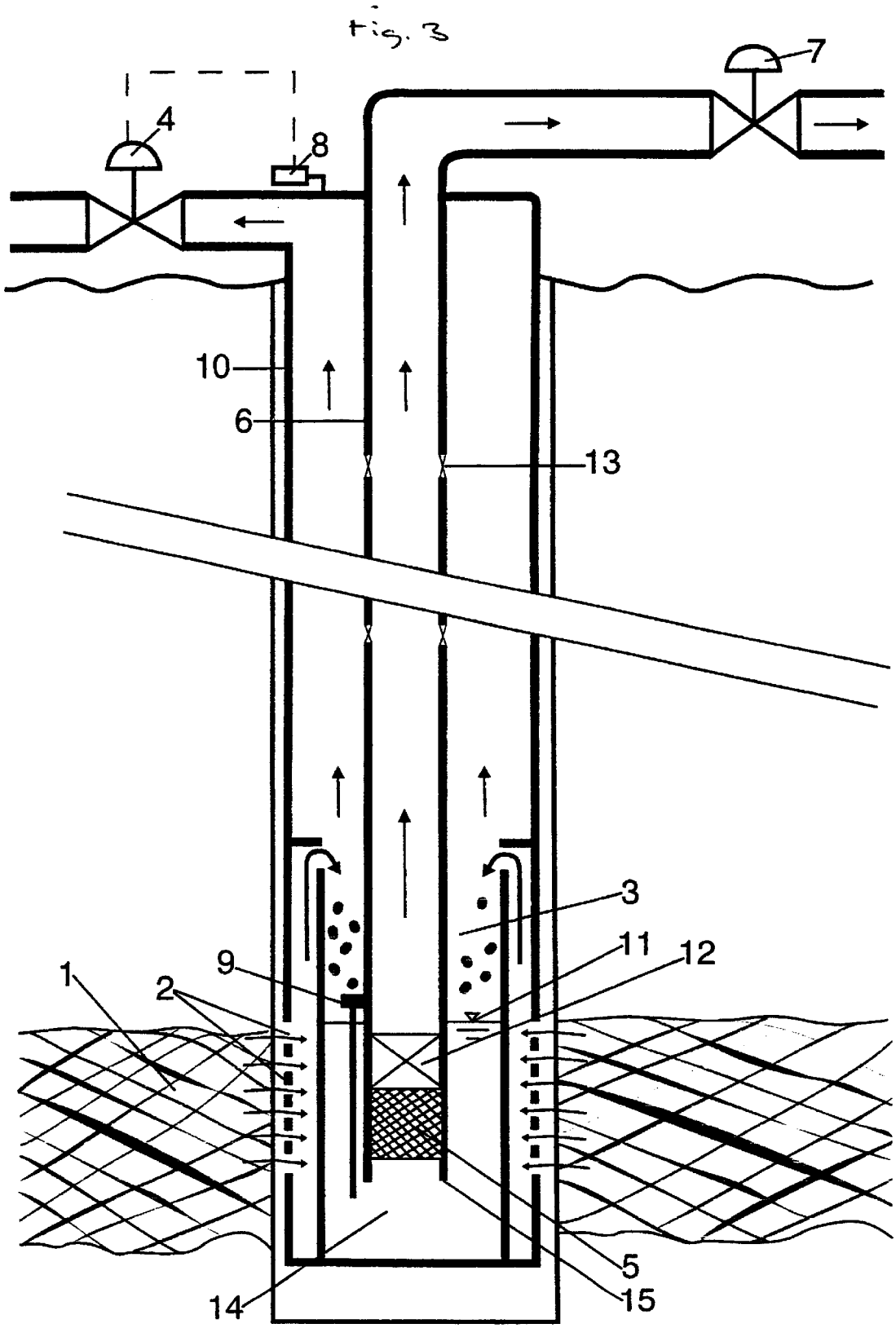
Figure 4:
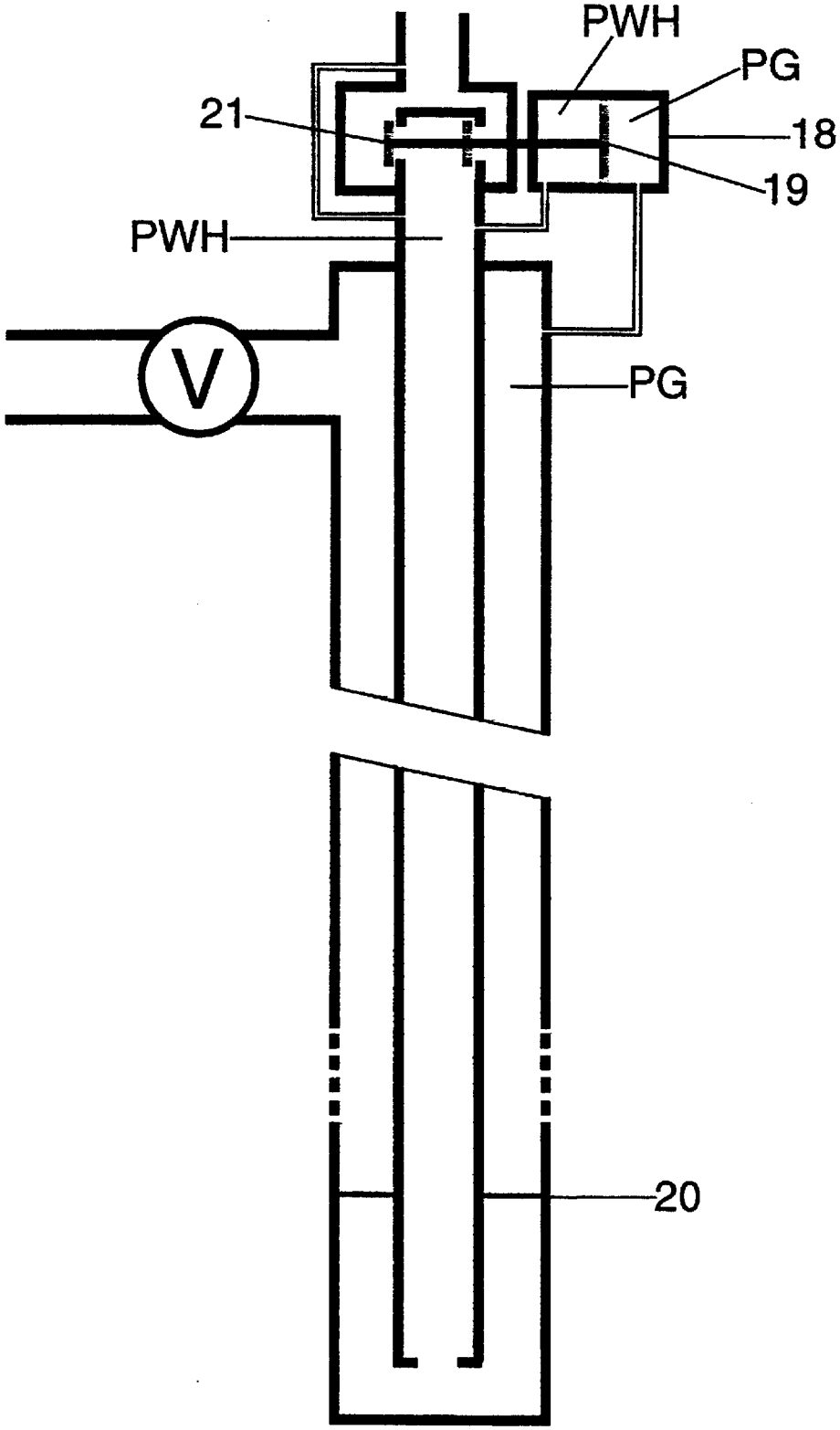
PRIOR ART Fig. 4

Another preferred embodiment of the present invention, now referring to FIGS. 2 and 3, is a slightly different arrangement regarding the oil and gas mixtures inlet into the ring-space 3. This preferred embodiment has two very important additional features than the first mentioned preferred embodiment.

First, the largest need for downhole pumping activity is usually present after a long time of production when reservoir pressure is becoming low, which implies that the drilling activity and tubes are already positioned. The perforations, that is the reservoir inlet, is then therefore positioned at the bottom at drilled hole, so there is no room for a oil bath in which a pump can be placed in. To drill a longer hole, and prolong the outer tubing would be an expensive operation. Thus, a way to generate a "oil-bath" at the same or higher level that the perforation are therefore very desirable, and this is what this second preferred embodiment accomplishes.

Secondly, this preferred embodiment has the opportunity to perform a separating process to a such degree of pureness, that the oil will remain gas-free throughout the whole transportation of the oil production.

Compared to what is shown in FIG. 1, this second preferred embodiment has an additional casing 16 (FIGS. 2 and 3) is inserted into the oil-bath 14. Outside this casing 16, at a lower height level are the perforations 2 positioned. This casing 16 heightens the inlet of the reservoir fluids 1 into ring-space 3, where the gravitational separation takes place.

Inlet valves 17 at the top of the casing 16, combined with a regulation system mentioned above when referring to FIG. 1, are controlling the inlet flow into the ring-space 3. This arrangement gives an additional control parameter to regulate the height of the gas seal level 11. If the gas seal level 11 is getting to low, the inlet valves 17 can be opened. An additional advantage here, is that the effective total distance from perforations 2 to gas seal level 11 is increased (sum of up, inside and then down), so that the time gas has to escape from oil is increased.

A further advantage by having the inlet valves 17, combined with gas pressure valve 4, is an accomplishment of having a complete control over the gas-pressure in ring space 3. This means that the gas pressure can be reduced to such low level that a completely separation take place. Gas will therefor not occur in the oil as it is produced upwards, since the oil already has been to this low pressure before it was pumped up.

This pressure control ability can also be accomplished in the first mentioned embodiment (FIG. 1), by establishing inlet valves (not drawn) in the perforations 2. Or alternatively insert an inner tubing (not drawn) over perforations 2 which encloses the reservoir inlet. With the new inner tubing containing inlet valves, this would result in the desired control ability.

To both above-mentioned preferred embodiments, there are a various number of possibilities to catalyze the gravitational separation. To mention some examples different kinds of grids could be applied in the ring-space 3 to enhance the separation, mist extractors or treads/wires could be applied in the ring-space 3 in which the oil could adhere to. Chemicals could be inserted as the mixture enters the separation or during the separation. Stationary or rotational bafflers could be inserted into the ring-space, making it easier for the gas to escape from the oil. Or further examples could be to design different shapes of perforations to affect the gravitational separation process.

What is claimed is:

1. Apparatus for effective production of oil and gas from an oil- and gas reservoir (1) comprising a borehole casing (10) with a plurality of perforations (2) or inlet-valves (17), positioned sufficiently enough above a gas seal level (11) to enable a gravitational separation process of gas from the reservoir (1) to take place in a ring space (3), and a tubing (6) which end (15) is positioned underneath the gas seal level (11) assuring only liquids being produced through the tube (6) characterized in that said apparatus comprises at least one submersible pump (5) positioned within the tubing (6), preferably the first pump (5) positioned at a height level underneath the gas-seal (11), a height level regulating system that regulates the height of the gas-seal level (11) preventing the gas seal level (11) from going underneath end (15) of tube (6) and in addition also preventing the gas seal level (11) rising so high that it disables an effective gravitational separation to take place, wherein said height level regulating system comprises a height monitoring means that monitors the height of the gas-seal level (11), and further comprising means for regulating the height of gas-seal level (11) by controlling the gas pressure in ring space (3) in combination with controlling one or more other distinct production features, said other distinct production features being selected from the group consisting of (i) adjustment of the power of pump(s) (5), and (ii) adjustment of a valve (12) positioned inside tube (6) slightly above the lowest of the pumps (5), and further whereby the control of the gas pressure in ring space (3) is accomplished by measuring the gas pressure in ring space (3) by a pressure meter (8) and regulating the pressure by a valve (4).

2. Apparatus according to claim 1 characterized in that the height monitoring means comprises a height measurer (9) positioned in the ring-space (3).

3. Apparatus according to claim 2 characterized by that a plurality of valves (13) are positioned along the tubing (6) allowing gas from ring-space (3) to enter the oil column inside tubing (6), which gives the oil column inside the tubing (6) an additional lift.

4. Apparatus according to claim 3 characterized by that an inner tubing (16) encloses the reservoir fluid inlet (2) preventing the reservoir fluid (1) flowing directly into the ring-space, and instead makes the fluid from reservoir (1) flow into the ring-space at a level higher than inlet (2), and where the inner tubing (16) in addition comprises one or more inlet valves (17) for additional control of inlet of enclosed reservoir fluid into ring-space (3).

5. Method for effective production of oil and gas from an oil- and gas reservoir (1) by bringing the oil and gas through a plurality of perforations (2) or inlet-valves (17), positioned sufficiently enough above a gas seal level (11) to enable a gravitational separation process of gas from the reservoir (1) to take place in a ring space (3), thus generating an oil bath (14) in which oil is produced through a tubing (6) which end (15) is underneath the gas-seal (11) characterized by supplying at least one pump (5) inside the tubing (6), where preferably the first pump (5) is positioned at a height level underneath the gas-seal (11), and where a height level regulating system of the gas-seal level (11) prevents the gas seal level (11) to go underneath the end (5) of tube (6) and in addition also prevents the gas seal level (11) rising so high that it disables an effective gravitational separation to take place, in which height level regulating system of the gas-seal level (11) accomplishes this by monitoring the height of the gas-seal level (11) and then controlling this gas-seal level (11) by monitoring and adjusting the gas pressure inside ring space (3) in addition to regulating one or more other distinct production features, such other distinct production features being selected from the group consisting of (i) adjustment of the power of pump(s) (5) and (ii) adjustment of a valve (12) positioned inside tube (6) slightly above the lowest of the pumps (5), and further whereby the gas pressure in ring space (3) is adjusted by measuring the gas pressure in ring space (3) by a pressure meter (8) and regulating the gas pressure by a valve (4).

6. Method according to claim 5 characterized by that the monitoring of the height of the gas-seal level (11) is accomplished by a height measurer (9) positioned in the ring-space (3).

7. Method according to claim 6 characterized by that a plurality of valves (13) are positioned along the tubing (6) allowing gas from ring-space (3) to enter the oil column inside tubing (6), which gives the oil column inside the tubing (6) an additional lift.

8. Method according to claim 7 characterized by that separated gas is produced up through ring-space (3).

9. Method according to claim 8 characterized by that an inner tubing (16) encloses the reservoir fluid inlet (2) preventing the fluid from reservoir (1) flowing directly into the ring space, and instead makes the fluid flow into the ring-space at a higher height level, and where the inner tubing (16) in addition can comprise inlet valves (17) for additional control of inlet of enclosed reservoir fluid into ring-space (3).

* * * * *